US008617782B2

(12) United States Patent
Momotani et al.

(10) Patent No.: US 8,617,782 B2
(45) Date of Patent: Dec. 31, 2013

(54) LIQUID DEVELOPER

(75) Inventors: Keiko Momotani, Ibaraki (JP); Yuya Kubo, Hachioji (JP); Masahiro Anno, Sakai (JP); Naoki Yoshie, Ibaraki (JP); Kenji Hayashi, Hachioji (JP); Chiaki Yamada, Ibaraki (JP); Miyuki Hotta, Kobe (JP)

(73) Assignee: Konica Minolta Business Technologies, Inc. (JP)

( * ) Notice: Subject to any disclaimer, the term of this patent is extended or adjusted under 35 U.S.C. 154(b) by 0 days.

(21) Appl. No.: 13/585,163

(22) Filed: Aug. 14, 2012

(65) Prior Publication Data

US 2013/0065176 A1 Mar. 14, 2013

(30) Foreign Application Priority Data

Sep. 9, 2011 (JP) ..... 2011-197380

(51) Int. Cl.
*G03G 9/125* (2006.01)

(52) U.S. Cl.
USPC ..... 430/116; 430/112

(58) Field of Classification Search
USPC ..... 430/112, 116
See application file for complete search history.

(56) References Cited

U.S. PATENT DOCUMENTS 5,073,470 A * 12/1991 Kato et al. ..... 430/114
5,536,615 A * 7/1996 Hopper et al. ..... 430/137.14

FOREIGN PATENT DOCUMENTS

JP 7-502604 A 3/1995
JP 2007-041162 A 2/2007

* cited by examiner

*Primary Examiner* — Peter Vajda
(74) *Attorney, Agent, or Firm* — Cantor Colburn LLP

(57) ABSTRACT

A liquid developer includes at least toner particles and an insulating liquid. The toner particles include a resin and a color material dispersed in the resin. 90 mass % or more of the insulating liquid is aliphatic saturated hydrocarbon having a carbon number of 11 to 16, and 20 to 60 mass % of the insulating liquid is aliphatic saturated hydrocarbon having a carbon number of 11 to 12.

8 Claims, 2 Drawing Sheets

LIQUID DEVELOPER

This application is based on Japanese Patent Application No. 2011-197380 filed with the Japan Patent Office on Sep. 9, 2011, the entire content of which is hereby incorporated by reference.

BACKGROUND OF THE INVENTION

1. Field of the Invention

The present invention relates to a liquid developer used for electrophotographic image forming apparatuses such as copying machine, printer, digital printing machine, and the like.

2. Description of the Related Art

In an electrophotographic image forming apparatus, a document image or an image based on image data is exposed on an electrostatic-latent-image carrier such as photoreceptor to thereby form an electrostatic latent image, the electrostatic latent image is developed with toner into a visible toner image, and the toner image is transferred to and fixed on a recording material to thereby form an intended image.

The development scheme used for such electrophotography may be classified into a dry development method and a wet development method. The dry development method uses only toner particles in performing development. In contrast, the wet development method uses a liquid developer (also called wet developer) in which toner particles are dispersed in an electrically insulating liquid (simply referred to as "insulating liquid", such an insulating liquid is also called carrier liquid) in performing development. The wet development method can use toner particles of a smaller particle size than that of the dry development method, and therefore can obtain a high definition image.

For example, while the limit of the particle size of toner particles for the dry development method is on the order of 5 μm, the particle size of toner particles for the wet development method can be reduced to a size on the order of submicron. Moreover, regarding the wet development method, reduction of the amount of consumed toner particles can be expected.

A preferred insulating liquid used for the liquid developer of the wet development method has a resistance to the extent that will not disturb the electrostatic latent image (on the order of $10^{11}$ to $10^{16}$ Ω·cm). The insulating liquid is more preferably a solvent without odor and toxicity. In general, examples of such an insulating liquid may be aliphatic hydrocarbon, alicyclic hydrocarbon, aromatic hydrocarbon, halogenated hydrocarbon, polysiloxane, and the like. In particular, in terms of odor, harmlessness, and cost, straight-chain or branched aliphatic saturated hydrocarbon (normal paraffin-based solvent or isoparaffin-based solvent) is suitably used.

For example, Japanese Laid-Open Patent Publication No. 2007-041162 discloses EXAMPLEs in which a first liquid paraffin (aliphatic saturated hydrocarbon) having a weight-average molecular weight of 250 (corresponding to a carbon number of 18) and a second liquid paraffin having a weight-average molecular weight of 800 (corresponding to a carbon number of 57) are mixed into an insulating liquid of a liquid developer, and discloses a result that the fixing strength is excellent. For this fixing, however, a condition is employed that an oven is used to perform thermal fixing at 120° C. for 30 minutes. Since the energy used here is extremely large, the fixing performed here is not an actually available one. Thus, the actually available fixing energy does not enable this insulating liquid to be sufficiently vaporized, and therefore it is expected that the fixing strength is weaker.

Japanese National Patent Publication No. 07-502604 discloses EXAMPLEs in which an insulating liquid of a liquid developer contains Isopar G (carbon number 10: 44%, carbon number 11-12: 56%), which is a commercially available product of aliphatic hydrocarbon, and a small amount of mineral oil (with a carbon number of 18 or more) added thereto. This insulating liquid is a combination of Isopar G having very high volatility and mineral oil having very low volatility. If the mineral oil is absent or the amount of added mineral oil is extremely small, offset occurs. If a greater amount of mineral oil is added, the fixing strength is weaker. Thus, prevention of offset and improvement of the fixing strength cannot both be achieved.

SUMMARY OF THE INVENTION

In an electrophotographic image forming apparatus, an image is formed by thermally fixing a liquid developer on a recording material. When the liquid developer is thermally fixed, the insulating liquid is present on the surface of toner particles to thereby serve to prevent offset (the phenomenon that toner particles are transferred to a fixing roller to contaminate the fixing roller). The presence of the insulating liquid in the toner particle or on the interface between the toner particles and paper, however, weakens the fixing strength. The liquid developer is therefore required to achieve both prevention of offset and improvement of the fixing strength. A liquid developer that adequately meets this requirement, however, has not been known.

The present invention has been made in view of the circumstances above, and an object of the invention is to provide a liquid developer serving to achieve both prevention of offset and improvement of the fixing strength.

The studies conducted by the inventors of the present invention have revealed that a liquid developer for which an insulating liquid is used that is made from straight-chain or branched aliphatic saturated hydrocarbon having a carbon number of 15 or more tends to deteriorate the fixing strength, since the insulating liquid in toner particles cannot sufficiently be vaporized by thermal fixing. It has also been revealed that a liquid developer for which an insulating liquid is used that is made from straight-chain or branched aliphatic saturated hydrocarbon having a carbon number of 12 or less tends to cause offset, since the insulating liquid on the surface of toner particles is vaporized to disappear by thermal fixing. The present invention has been completed based on the findings above and through further thorough studies.

Specifically, a liquid developer of the present invention includes at least toner particles and an insulating liquid. The toner particles include a resin and a color material dispersed in the resin. 90 mass % or more of the insulating liquid is aliphatic saturated hydrocarbon having a carbon number of 11 to 16, and 20 to 60 mass % of the insulating liquid is aliphatic saturated hydrocarbon having a carbon number of 11 to 12.

Preferably, 40 to 70 mass % of the insulating liquid is aliphatic saturated hydrocarbon having a carbon number of 15 to 16.

The liquid developer of the present invention has the above-described features to thereby produce a beneficial effect that prevention of offset and improvement of the fixing strength can both be achieved.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
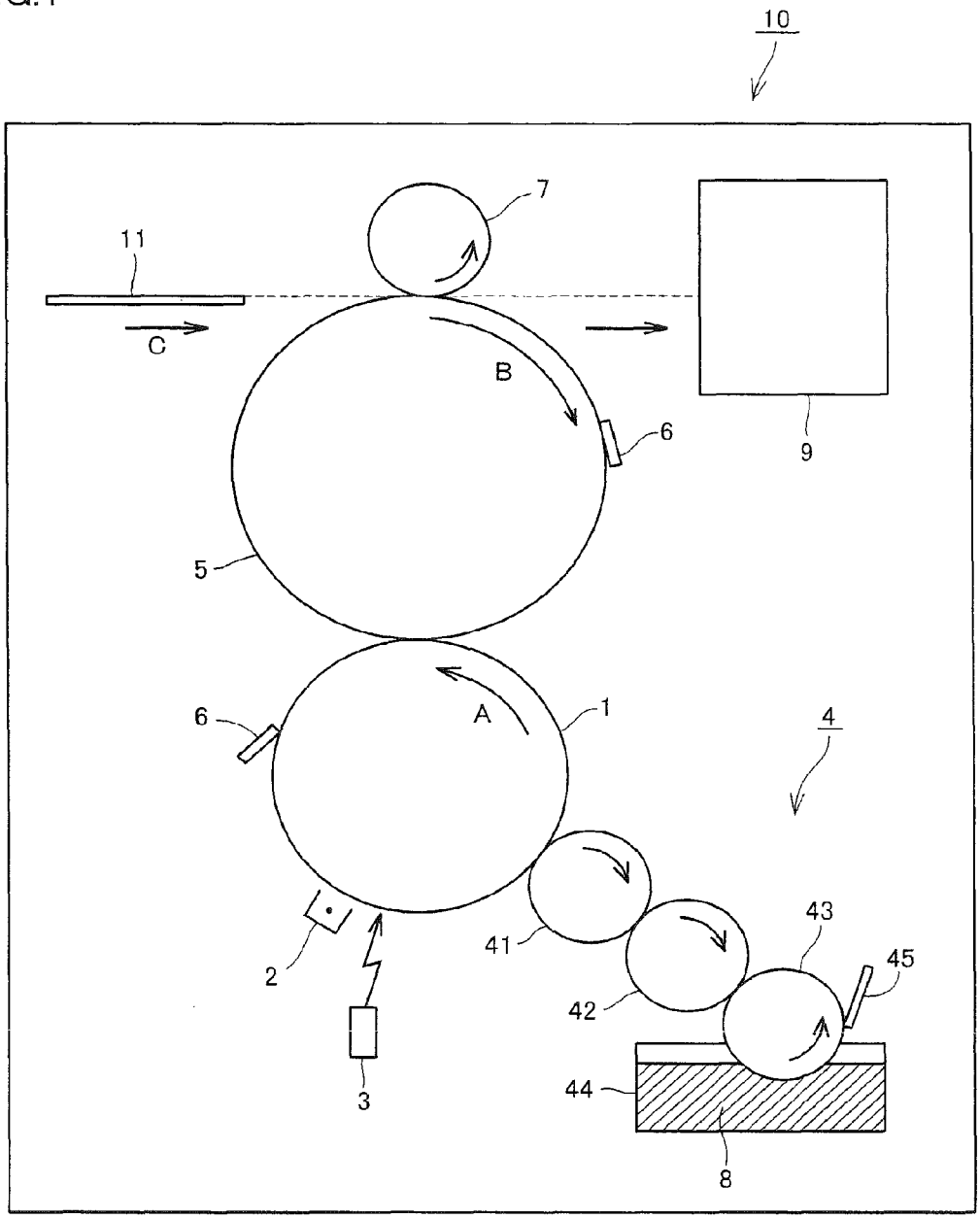
FIG. 1 is a schematic conceptual diagram of an electrophotographic image forming apparatus.

In the following, an embodiment of the present invention will be described in more detail.

<Liquid Developer>

A liquid developer of the present embodiment includes at least toner particles and an insulating liquid. As long as the liquid developer includes these components, the liquid developer may include other arbitrary components. Examples of other components may be dispersant, charge control agent, thickener, and the like.

The ratio between the contents of the components of the liquid developer may for example be 10 to 50 mass % of the toner particles and the remainder of the insulating liquid and arbitrary components if any. If the content of the toner particles is less than 10 mass %, the toner particles are likely to settle, and the stability with time during a long-term storage tends to deteriorate. Moreover, in order to obtain a required image density, a large amount of the liquid developer must be fed and accordingly the amount of the insulating liquid attached to a recording material such as paper increases. In this case, the need arises to dry the insulating liquid in the fixing process and resultant vapor could cause an environmental problem. In contrast, if the content of the toner particles is larger than 50 mass %, the liquid developer has excessively high viscosity. Such a liquid developer tends to difficult to manufacture and handle.

The viscosity of the liquid developer at 25° C. is preferably not less than 0.1 mPa·s and not more than 10000 mPa·s. If the viscosity is larger than 10000 mPa·s, the liquid developer is difficult to stir. In this case, toner particles cannot uniformly be dispersed in the insulating liquid and a heavy burden may be imposed on the apparatus used for obtaining the liquid developer. In contrast, if the viscosity is smaller than 0.1 mPa·s, toner particles are likely to settle, the stability with time during a long-term storage may deteriorate and the image density may be unstable.

The liquid developer as described above is useful as a developer for an electrophotographic image forming apparatus.

<Toner Particles>

The toner particles included in the liquid developer of the present embodiment include a resin and a color material dispersed in the resin. As long as the toner particles include these components, the toner particles may include other arbitrary components. Examples of other components may be wax, dispersant (pigment dispersant), charge control agent, and the like.

The aforementioned resin is also called binder resin and is preferably a thermoplastic resin. The composition of the resin is not particularly limited, and any conventionally known resin used in this type of application can be used without being particularly limited. For example, polyester resin, styrene acrylic copolymer resin, styrene acrylic modified polyester resin, polyolefin copolymer (particularly ethylene-based copolymer), epoxy resin, resin modified phenolic resin, resin modified maleic resin, and the like, may be used.

As to the resin, a resin having a high acid value is preferred, and the acid value is preferably on the order of 20 mgKOH/g to 100 mgKOH/g, for example. A high acid value is preferred since it improves adhesion to paper and also forms a three-dimensional structure to thereby enable prevention of plasticization due to the insulating liquid. While plasticization caused by the insulating liquid could lower the fixing strength, the resin having a high acid value can prevent this.

As the color material, a known pigment or dye may be used. Among the pigments, examples of organic pigments may be carbon black, phthalocyanine-based pigments, azo-based pigments such as azo-, disazo-, and polyazo-based pigments, anthraquinone-based pigments, quinacridone-based pigments, dioxazine-based pigments, perinone-based pigments, thioindigo-based pigments, isoindoline-based pigments, and the like. More specifically, examples of the organic pigments may be ortho aniline black, toluidine orange, permanent carmine FB, fast yellow AAA, disazo orange PMP, lake red C, brilliant carmine 6B, quinacridone red, C.I. pigment blue 1, 7, 15, 15:1, 15:2, 15:3, 15:4, 15:6, 60, 62, 66, C.I. pigment red 2, 3, 5, 6, 7, 23, 48:2, 48:3, 48:4, 57:1, 81, 81:1, 81:2, 81:3, 81:4, 122, 144, 146, 166, 169, 177, 184, 185, 202, 206, 209, 220, 221, 254, 255, 268, 269, C.I. pigment yellow 12, 13, 14, 15, 17, 62, 74, 83, 93, 94, 95, 97, 109, 110, 111, 120, 127, 128, 129, 138, 139, 147, 150, 168, 174, 176, 180, 181, 191, dioxane violet, Victoria pure blue, alkaline blue toner, alkaline blue R toner, fast yellow 10G, orthonitro aniline orange, toluidine red, and the like. Examples of inorganic pigments may be furnace black, lamp black, acetylene black, channel black, C.I. pigment black and ortho aniline black, barium red 2B, calcium red 2B, pigment scarlet 3B lake, anthocyn 3B lake, rhodamine 6B lake, methyl violet lake, basic blue 6B lake, fast sky blue, reflex blue G, brilliant green lake, phthalocyanine green G, Prussian blue, ultramarine, iron oxide powder, zinc white, calcium carbonate, clay, barium sulfate, alumina white, aluminum powder, daylight fluorescent pigment, pearl pigment, and the like.

In order to improve the dispersibility of the pigment, a pigment derivative treated so that it is basic or acid may be used. The pigment such as those as described above is dispersed in the resin, and preferably the pigment having a particle size of 50 to 300 nm is dispersed. If the particle size of the pigment is larger than 300 nm, it may be difficult to obtain sufficient coloring and hiding by a certain amount of the attached pigment and the transparency may be deteriorated after fixing. In contrast, if the particle size of the pigment is smaller than 50 nm, the pigment may be difficult to manufacture.

The content of the pigment is 8 to 50 mass %, and is preferably 10 to 30 mass % with respect to the resin. If the content of the pigment is less than 8 mass %, a desired density may not be obtained. If the content is more than 50 mass %, the dispersibility in the resin and the fixing quality could be degraded. The suitable content varies depending on the color. Preferably the content of a cyan pigment is 10 to 40 mass %, the content of a magenta pigment is 15 to 50 mass %, and the content of a yellow pigment is 10 to 40 mass %, with respect to the resin. The suitable content also varies depending on the particle size, and a smaller particle size enables a higher content of the pigment.

The particle size of the toner particles as described above is not particularly limited. For the sake of obtaining a high-quality image, the suitable particle size is 0.1 to 5 μm, and is more preferably 1 to 3 μm. If the particle size of the toner particles is smaller than 0.1 μm, the development quality is considerably deteriorated. If the particle size is larger than 5 μm, the image quality tends to be degraded. The particle size in the present embodiment refers to an average particle size and can be identified as a volume-average particle size by means of a variety of particle size analyzers.

<Insulating Liquid>

The insulating liquid included in the liquid developer of the present embodiment has a feature that 90 mass % or more of the insulating liquid is aliphatic saturated hydrocarbon having a carbon number of 11 to 16, and 20 to 60 mass % (not less than 20 mass % and not more than 60 mass %) of the insulating liquid is aliphatic saturated hydrocarbon having a carbon number of 11 to 12. The liquid developer thus includes the insulating liquid as described above to thereby produce a beneficial effect that prevention of offset and improvement of the fixing strength can both be achieved when the liquid developer is thermally fixed. It is inferred that this beneficial effect is produced for the following reason. Namely, the aliphatic saturated hydrocarbon having a carbon number of 11 to 12 that is included at the above-indicated ratio chiefly serves to vaporize to an appropriate extent in the fixing process and thereby improve the fixing strength, and the remainder aliphatic saturated hydrocarbon having a carbon number of 13 to 16 chiefly serves to cover toner particles to an appropriate extent in the thermal fixing process and thereby prevent offset. The aliphatic saturated hydrocarbon having a carbon number of 11 to 12 and the aliphatic saturated hydrocarbon having a carbon number of 13 to 16 work synergistically to produce the above-described beneficial effect.

The insulating liquid of the present embodiment is preferably made up of only the aliphatic saturated hydrocarbon having a carbon number of 11 to 16 except for inevitable impurities. Here, the aliphatic saturated hydrocarbon in the present embodiment is preferably straight-chain or branched aliphatic saturated hydrocarbon (namely normal paraffin-based solvent or isoparaffin-based solvent) in terms of electrical insulation, odor, harmlessness, cost, and the like. If the ratio of the aliphatic saturated hydrocarbon having a carbon number of 11 to 16 relative to the insulating liquid is less than 90 mass %, the effect of prevention of offset and improvement of the fixing strength fails to be produced.

The insulating liquid is also required to include 20 to 60 mass % of aliphatic saturated hydrocarbon having a carbon number of 11 to 12 relative to the insulating liquid. If this content is less than 20 mass %, a disadvantage arises that the insulating liquid vaporizes insufficiently and thus the fixing strength tends to be weak. If the content is more than 60 mass %, a disadvantage arises that the insulating liquid vaporizes and accordingly the amount of the insulating liquid decreases and thus offset tends to occur. A more preferred content of the aliphatic saturated hydrocarbon having a carbon number of 11 to 12 is 30 to 50 mass %.

Meanwhile, in the insulating liquid having the composition as described above, preferably aliphatic saturated hydrocarbon having a carbon number of 15 to 16 is 40 to 70 mass % relative to the insulating liquid. The aliphatic saturated hydrocarbon having a carbon number of 15 to 16 that is included at the above-indicated ratio enables the above-described effect to be produced in a more distinguishable manner. If the content of the aliphatic saturated hydrocarbon having a carbon number of 15 to 16 is less than 40 mass %, offset may be likely to occur when the fixing temperature is high. If the content of the aliphatic saturated hydrocarbon having a carbon number of 15 to 16 is more than 70 mass %, the fixing strength may be likely to become weak when the fixing temperature is low.

While it is preferable that the aliphatic saturated hydrocarbon has a straight-chain or branched structure as described above, the structure of the branched aliphatic saturated hydrocarbon is not particularly limited, and may include any of the isomers.

As the insulating liquid having the above-described composition, two or more different high-purity aliphatic saturated hydrocarbons each having a single structure may be mixed together to be used. Alternatively, in terms of economy, availability, and the like, any of a variety of commercially available products may be used. Examples of the commercially available products including, as their main component, straight-chain or branched aliphatic saturated hydrocarbon having a carbon number of 11 to 16, may be "Isopar H" (trademark), "Isopar L" (trademark), and "Isopar M" (trademark) manufactured by Exxon Mobil Chemical, "IP1620" (trademark), "IP2028" (trademark), "IP clean LX" (trademark), and "IP clean HX" (trademark) manufactured by Idemitsu Chemicals, "Shellsol TK" (trademark) and "Shellsol TM" (trademark) manufactured by Shell Chemicals, and "Marukasol" (trademark) manufactured by Maruzen Petrochemical. If a commercially available product can singly be used to obtain the insulating liquid having the above-described composition, such a commercially available product can singly be used. Usually, however, two or more commercially available products as mentioned above may be mixed together to obtain the insulating liquid having the composition as described above.

If the insulating liquid is not made up of only the aliphatic saturated hydrocarbon having a carbon number of 11 to 16, other components included in the insulating liquid may be aliphatic saturated hydrocarbon having a carbon number other than 11 to 16, alicyclic hydrocarbon, vegetable oil, mineral oil, and the like.

<Dispersant>

The liquid developer of the present embodiment may include a small amount of a dispersant which is added as required. For example, 0.01 to 10 mass % of a dispersant is preferably added to the above-described toner particles.

Such a dispersant has a function of dispersing the toner particles stably in the insulating liquid. In order for this function to be performed sufficiently, a dispersant that is soluble in the insulating liquid is preferably used. As long as the dispersant allows the toner particles to be dispersed stably, the type of the dispersant is not particularly limited. In the case where the above-described resin (particularly polyester resin) has a relatively high acid value, a basic polymer dispersant is preferably used. A particular example of the basic polymer dispersants that satisfies long-term storage stability may be a basic polymer dispersant having an N-vinylpyrrolidone group, or the like.

Examples of this basic polymer dispersant having an N-vinylpyrrolidone group may be a random copolymer or a graft copolymer of N-vinyl-2-pyrrolidone and methacrylate. Instead of the methacrylate, acrylate or alkylene compound may also be used. The carbon number of an alkyl group of methacrylate or acrylate used here is preferably on the order of 10 to 20. The alkylene compound used here includes an alkyl group and the alkyl group preferably has a carbon number on the order of 10 to 30.

As the basic polymer dispersant having an N-vinylpyrrolidone group, a commercially available product can also be used. Examples of such a commercially available product may be "Antaron V-216" (trademark), "Antaron V-220" (trademark) and the like manufactured by GAF/ISP Chemicals.

<Manufacturing Method>

The liquid developer of the present embodiment may be manufactured in accordance with a conventionally known method, and the method of manufacturing the liquid developer is not particularly limited. For example, a resin and a pigment which is a color material are blended at a predetermined ratio therebetween, and melt and kneaded by means of a pressure kneader, roll mill or the like, so that the pigment is dispersed uniformly in the resin, to thereby obtain a pigment-dispersed resin. The obtained pigment-dispersed resin is finely pulverized by means of a jet mill for example to thereby obtain fine particles. Subsequently, the obtained fine particles are classified by means of a wind classifier for example to thereby obtain toner particles having a predetermined particle size.

Subsequently, the obtained toner particles are mixed with an insulating liquid at a predetermined ratio to thereby obtain a mixture. Then the mixture is uniformly dispersed by dispersing means such as ball mill to thereby obtain a liquid developer.

According to the description above, the method that pulverizes the pigment-dispersed resin is used. The method for obtaining fine particles to be used as toner particles, however, is not limited to this method only. For example, a method according to which toner particles are granulated in the insulating liquid, or a method according to which toner particles are granulated in a polar solvent and the polar solvent is replaced with an insulating liquid, or the like, can also be used.

<Image Forming Method>

The liquid developer of the present invention is used in electrophotographic image forming apparatuses such as copying machine, printer, digital printing machine, simplified printing machine, and the like, for forming an image. Generally, these image forming apparatuses use an electrophotographic image forming process in common. In the following, an image forming method using the liquid developer of the present invention will be described with reference to FIG. 1.

FIG. 1 shows an example of the overall configuration of an image forming apparatus. FIG. 1 mainly shows only the components involved in the image forming process, and shows the components involved in feeding, transporting, and discharging of the recording material in a simplified manner.

Image forming apparatus 10 in FIG. 1 includes a photoreceptor drum 1 serving as an image carrier, a charging device 2, an exposure device 3, a wet development device 4, and a cleaning device 6. Image forming apparatus 10 also includes an intermediate transfer roller 5, which serves as an intermediate transfer unit, and a secondary transfer roller 7.

While only one wet development device 4 is disposed in FIG. 1, a plurality of wet development devices may be disposed for forming a color image. The color development scheme, whether to perform intermediate transfer or not, and the like, may be determined in an arbitrary manner, and accordingly an arbitrary arrangement configuration may be employed.

While this image forming apparatus uses intermediate transfer roller 5, it may be in the form of an intermediate transfer belt. Photoreceptor drum 1 has a cylindrical shape having its surface on which a photoreceptor layer (not shown) is formed, and rotates in the direction indicated by an arrow A in FIG. 1. Along the outer periphery of photoreceptor drum 1, cleaning device 6, charging device 2, exposure device 3, wet development device 4, and intermediate transfer roller 5 are arranged in order in the direction in which photoreceptor drum 1 rotates. This system is capable of operating usually at 100 to 1000 mm/sec.

Charging device 2 causes the surface of photoreceptor drum 1 to be charged to a predetermined potential. Exposure device 3 irradiates the surface of photoreceptor drum 1 with light and lowers the charge level within the irradiated region to thereby form an electrostatic latent image.

Wet development device 4 develops the latent image formed on photoreceptor drum 1. Specifically, it transports the liquid developer to a development region of photoreceptor drum 1, and feeds toner particles included in the liquid developer to the electrostatic latent image on the surface of photoreceptor drum 1, to thereby form a toner image.

Wet development device 4 generally includes: a development roller 41 having its surface carrying a thin layer of the liquid developer for developing the latent image on photoreceptor drum 1 which is an image carrier; a transport roller 42 abutting on development roller 41 for transferring to the surface of development roller 41 the liquid developer with its amount adjusted; a feed roller 43 abutting on transport roller 42 for feeding liquid developer 8 in a developer tank 44 to the surface of transport roller 42; and a restriction blade 45 for adjusting the amount of supplied liquid developer 8.

In a development process, a development bias voltage of the same polarity as toner particles is applied from a power supply (not shown) to development roller 41 of wet development device 4. Depending on the balance between the bias voltage and the potential of the latent image on photoreceptor drum 1 which is also of the same polarity as toner particles, a difference in magnitude between electric fields is generated. In accordance with the latent image, the toner in the developer is electrostatically adsorbed on photoreceptor drum 1 and accordingly the latent image on photoreceptor drum 1 is developed.

Intermediate transfer roller 5 is placed to face photoreceptor drum 1 and rotates in the direction of an arrow B while contacting photoreceptor drum 1. At a nip portion between intermediate transfer roller 5 and photoreceptor drum 1, primary transfer from photoreceptor drum 1 to intermediate transfer roller 5 is performed.

In the primary transfer process, a transfer bias voltage of the opposite polarity to the toner particles is applied from a power supply (not shown) to intermediate transfer roller 5. Accordingly, an electric field is formed between intermediate transfer roller 5 and photoreceptor drum 1 at a primary transfer position, and the toner image on photoreceptor drum 1 is electrostatically adsorbed on intermediate transfer roller 5 and transferred onto intermediate transfer roller 5.

As the toner image is transferred to intermediate transfer roller 5, cleaning device 6 removes residual toner particles on photoreceptor drum 1, and the subsequent image forming process is performed. Intermediate transfer roller 5 and secondary transfer roller 7 are arranged so that they face each other with a recording material 11 located therebetween, and rotate while contacting each other with recording material 11 therebetween. At a nip portion between intermediate transfer roller 5 and secondary transfer roller 7, secondary transfer from intermediate transfer roller 5 to recording material 11 is performed.

Recording material 11 is transported in the direction of an arrow C to a secondary transfer position at the timing adapted to the timing of secondary transfer. In the secondary transfer process, a transfer bias voltage of the opposite polarity to the toner particles is applied from a power supply (not shown) to secondary transfer roller 7. Accordingly, an electric field is formed between intermediate transfer roller 5 and secondary transfer roller 7, and the toner image on intermediate transfer roller 5 is electrostatically adsorbed on recording material 11 having passed the portion between intermediate transfer roller 5 and secondary transfer roller 7, and transferred on recording material 11.

Figure 2:
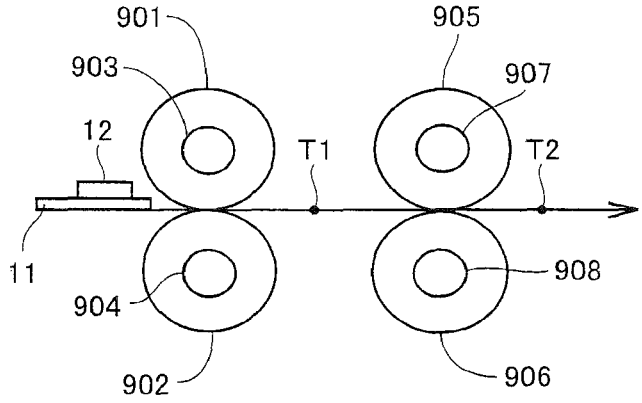
FIG. 2 is a schematic conceptual diagram showing a fixing unit of an electrophotographic image forming apparatus.
Figure 3:
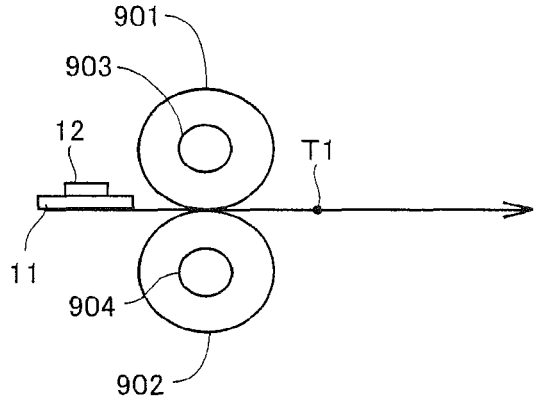
FIG. 3 is another schematic conceptual diagram showing a fixing unit of an electrophotographic image forming apparatus.

A fixing unit 9 is shown in more detail in FIGS. 2 and 3, includes at least one pair of rollers that are arranged to face each other and rotate while contacting each other, and recording material 11 is pressurized under a high temperature condition. Accordingly, toner particles forming a toner image 12 on recording material 11 are fused and fixed on recording material 11.

As shown in FIG. 2, fixing unit 9 includes fixing rollers 901, 905, heating rollers 902, 906, and heaters 903, 904, 907, 908. The system speed is 100 to 1000 mm/sec.

Fixing rollers 901, 905 each include a cored bar having a peripheral surface on which an elastic layer is formed. The cored bar has an outer diameter of 35 mm for example. The elastic layer is for example a silicone rubber layer having a thickness of 15 mm covered with polytetrafluoroethylene. The outer diameter of the whole of fixing rollers 901, 905 is for example 80 mm.

Heating rollers 902, 906 each include a cored bar having a peripheral surface covered with a silicone rubber layer of 1 mm and further with polytetrafluoroethylene (PTFE) for example. These heating rollers 902, 906 each have an outer diameter of 80 mm for example.

Heaters 903, 904, 907, 908 are halogen lamps for example. The fixing rollers and the heating rollers are heated so that a required paper temperature is reached. Depending on the type and the thickness of paper and the rate at which paper is fed, heating conditions may be determined as appropriate. Heating means may be provided as required on the upstream side and/or the downstream side of the fixing unit.

FIG. 3 is similar to FIG. 2 except that a single stage of rollers is provided in the fixing unit in contrast to FIG. 2. The configuration of fixing unit 9 is not limited to those shown in FIGS. 2 and 3. For example, instead of roller heating, belt heating may be employed, and non-contact heating or hot air may be used in combination with roller heating or belt heating. It should be noted that the recording material must be passed through fixing members which apply surface pressure to the recording material, as done in the case of roller heating and belt heating, in order to obtain stable gloss. For this sake, offset must be prevented.

EXAMPLES

In the following, the present invention will be described in more detail in connection with Examples. The present invention, however, is not limited to them.

1. Manufacture of Resin

<Polyester Resin A>

In a round-bottom flask having a reflex condenser, a water-alcohol separator, a nitrogen gas feed pipe, a thermometer, and a stirring device, 1600 parts by mass of propylene oxide 2-mol adduct of bisphenol A (trademark: "BA-2 glycol" manufactured by Nippon Nyukazai Co. Ltd.) (polyalcohol), 550 parts by mass of terephthalic acid, and 340 parts by mass of trimeilitic acid were placed, and stirred while nitrogen gas was fed, and dehydration polycondensation or dealcohollization polycondensation was performed at a temperature of 200 to 240° C.

After this, when the molecular weight of the resultant product reached a desired value, the temperature of the reaction system was lowered to 100° C. or less to stop polycondensation. In this way, a thermoplastic polyester resin was obtained. This thermoplastic polyester resin is referred to as "polyester resin A." The measured molecular weight of polyester resin A was Mw=15000 and Mn=4000. Mw and Mn were each calculated from the results of gel permeation chromatography. Gel permeation chromatography was performed using a high-speed liquid chromatography pump (TRI ROTAR-V type (manufactured by JASCO corporation)), a UV spectroscopic detector (UVIDEC-100-V type (manufactured by JASCO Corporation)), and a column of 50 cm in length (Shodex GPC A-803 (manufactured by Showa Denko K.K.)). From the results of the chromatography, the molecular weight of a sample to be tested was calculated based on polystyrene conversion where polystyrene was used as a standard substance to thereby determine Mw and Mn. The sample used here was 0.05 g of resin dissolved in 20 ml of tetrahydrofuran (THF).

<Polyester Resin B>

In a round-bottom flask similar to the above-described one, 1600 parts by mass of propylene oxide 2-mol adduct of bisphenol A (identical to the above-described one) (polyalcohol), 690 parts by mass of terephthalic acid, and 200 parts by mass of trimellitic acid were placed, and stirred while nitrogen gas was fed, and dehydration polycondensation or dealcohollization polycondensation was performed at a temperature of 200 to 240° C.

After this, when the molecular weight of the resultant product reached a desired value, the temperature of the reaction system was lowered to 100° C. or less to stop polycondensation. In this way, a thermoplastic polyester resin was obtained. This thermoplastic polyester resin is referred to as "polyester resin B." The molecular weight of polyester resin B was measured in a similar manner to that for polyester resin A and the measured molecular weight was Mw=4800 and Mn=2000.

<Polyester Resin C>

In a round-bottom flask similar to the above-described one, 1600 parts by mass of propylene oxide 2-mol adduct of bisphenol A (identical to the above-described one) (polyalcohol), and 890 parts by mass of terephthalic acid were placed, and stirred while nitrogen gas was fed, and dehydration polycondensation or dealcohollization polycondensation was performed at a temperature of 200 to 240° C.

After this, when the molecular weight of the resultant product reached a desired value, the temperature of the reaction system was lowered to 100° C. or less to stop polycondensation. In this way, a thermoplastic polyester resin was obtained. This thermoplastic polyester resin is referred to as "polyester resin C." The molecular weight of polyester resin C was measured in a similar manner to that for polyester resin A and the measured molecular weight was Mw=2500 and Mn=1200.

2. Manufacture of Toner Particles

<Toner Particles A>

100 parts by mass of polyester resin A as a resin and 15 parts by mass of copper phthalocyanine blue as a color material (pigment) were sufficiently mixed by means of a Henschel mixer, and thereafter melted and kneaded by means of a co-direction rotating twin shaft extruder at a heating temperature in the roll of 100° C., to thereby obtain a mixture. Then, the obtained mixture was cooled and thereafter roughly pulverized by means of a feather mill (manufactured by Hosokawa Micron Corporation) to thereby obtain roughly pulverized toner particles.

Subsequently, a counter jet mill (trademark: "200AFG" manufactured by Hosokawa Micron Corporation) was used to finely pulverize the obtained roughly-pulverized toner particles to thereby obtain toner particles. The toner particles are referred to as "toner particles A." The volume-average particle size of toner particles A was measured with a particle size analyzer (trademark: "SALD-2200" manufactured by Shimadzu Corporation) and it was 2.6 μm. Tm (melting temperature) was 155° C. Tm (melting temperature) was measured in accordance with a method described below.

<Toner Particles B>

Toner particles were obtained in a similar manner to that for toner particles A except that polyester resin A was replaced with polyester resin B. The resultant toner particles are referred to as "toner particles B." The volume-average particle size of toner particles B was 1.9 μm and Tm was 131° C.

<Toner Particles C>

Toner particles were obtained in a similar manner to that for toner particles A except that polyester resin A was replaced with polyester resin C. The resultant toner particles are referred to as "toner particles C." The volume-average particle size of toner particles C was 2.1 μm and Tm was 97° C.

3. Manufacture of Liquid Developer

Liquid developers A1 to A4, B1 to B4, and C1 to C4 of Examples of the present invention and liquid developers A5 to A8, B5 to B8, and C5 to C8 of Comparative Examples were manufactured in the following way.

<Liquid Developer A1>

43 parts by mass of toner particles A as the toner particles, 50 parts by mass of Isopar H (trademark, manufactured by Exxon Mobil Chemical) and 50 parts by mass of Shellsol TM (trademark, manufactured by Shell Chemicals) as the insulating liquid, and 1 part by mass of N-vinylpyrrolidone/alkylene copolymer (trademark: "Antaron V-216" manufactured by GAF/ISP Chemicals) as the dispersant were mixed, treated by means of a paint shaker for one hour to thereby obtain liquid developer A1.

<Liquid Developer A2>

Liquid developer A2 was obtained in a similar manner to that for liquid developer A1 except that the insulating liquid used for liquid developer A1 was replaced with 50 parts by mass of Isopar L (trademark, manufactured by Exxon Mobil Chemical) and 50 parts by mass of IP2028 (trademark, manufactured by Idemitsu Chemicals).

<Liquid Developer A3>

Liquid developer A3 was obtained in a similar manner to that for liquid developer A1 except that the insulating liquid used for liquid developer A1 was replaced with 20 parts by mass of IP1620 (trademark, manufactured by Idemitsu Chemicals) and 80 parts by mass of IP2028 (trademark, manufactured by Idemitsu Chemicals).

<Liquid Developer A4>

Liquid developer A4 was obtained in a similar manner to that for liquid developer A1 except that the insulating liquid used for liquid developer A1 was replaced with 10 parts by mass of Isopar G (trademark, manufactured by Exxon Mobil Chemical) and 90 parts by mass of IP2028 (trademark, manufactured by Idemitsu Chemicals).

<Liquid Developer B1>

43 parts by mass of toner particles B as the toner particles, 50 parts by mass of Isopar H (trademark, manufactured by Exxon Mobil Chemical) and 50 parts by mass of Shellsol TM (trademark, manufactured by Shell Chemicals) as the insulating liquid, and 1 part by mass of N-vinylpyrrolidone/alkylene copolymer (trademark: "Antaron V-216" manufactured by GAF/ISP Chemicals) as the dispersant were mixed, treated by means of a paint shaker for one hour to thereby obtain liquid developer B1.

<Liquid Developer B2>

Liquid developer B2 was obtained in a similar manner to that for liquid developer B1 except that the insulating liquid used for liquid developer B1 was replaced with 50 parts by mass of Isopar L (trademark, manufactured by Exxon Mobil Chemical) and 50 parts by mass of IP2028 (trademark, manufactured by Idemitsu Chemicals).

<Liquid Developer B3>

Liquid developer B3 was obtained in a similar manner to that for liquid developer B1 except that the insulating liquid used for liquid developer B1 was replaced with 20 parts by mass of IP1620 (trademark, manufactured by Idemitsu Chemicals) and 80 parts by mass of IP2028 (trademark, manufactured by Idemitsu Chemicals).

<Liquid Developer B4>

Liquid developer B4 was obtained in a similar manner to that for liquid developer B1 except that the insulating liquid used for liquid developer B1 was replaced with 10 parts by mass of Isopar G (trademark, manufactured by Exxon Mobil Chemical) and 90 parts by mass of IP2028 (trademark, manufactured by Idemitsu Chemicals).

<Liquid Developer C1>

43 parts by mass of toner particles C as the toner particles, 50 parts by mass of Isopar H (trademark, manufactured by Exxon Mobil Chemical) and 50 parts by mass of Shellsol TM (trademark, manufactured by Shell Chemicals) as the insulating liquid, and 1 part by mass of N-vinylpyrrolidone/alkylene copolymer (trademark: "Antaron V-216" manufactured by GAF/ISP Chemicals) as the dispersant were mixed, treated by means of a paint shaker for one hour to thereby obtain liquid developer C1.

<Liquid Developer C2>

Liquid developer C2 was obtained in a similar manner to that for liquid developer C1 except that the insulating liquid used for liquid developer C1 was replaced with 50 parts by mass of Isopar L (trademark, manufactured by Exxon Mobil Chemical) and 50 parts by mass of IP2028 (trademark, manufactured by Idemitsu Chemicals).

<Liquid Developer C3>

Liquid developer C3 was obtained in a similar manner to that for liquid developer C1 except that the insulating liquid used for liquid developer C1 was replaced with 20 parts by mass of IP1620 (trademark, manufactured by Idemitsu Chemicals) and 80 parts by mass of IP2028 (trademark, manufactured by Idemitsu Chemicals).

<Liquid Developer C4>

Liquid developer C4 was obtained in a similar manner to that for liquid developer C1 except that the insulating liquid used for liquid developer C1 was replaced with 10 parts by mass of Isopar G (trademark, manufactured by Exxon Mobil Chemical) and 90 parts by mass of IP2028 (trademark, manufactured by Idemitsu Chemicals).

<Liquid Developer A5>

Liquid developer A5 was obtained in a similar manner to that for liquid developer A1 except that the insulating liquid used for liquid developer A1 was replaced with 100 parts by mass of Isopar G (trademark, manufactured by Exxon Mobil Chemical).

<Liquid Developer A6>

Liquid developer A6 was obtained in a similar manner to that for liquid developer A1 except that the insulating liquid used for liquid developer A1 was replaced with 100 parts by mass of IP1620 (trademark, manufactured by Idemitsu Chemicals).

<Liquid Developer A7>

Liquid developer A7 was obtained in a similar manner to that for liquid developer A1 except that the insulating liquid used for liquid developer A1 was replaced with 100 parts by mass of IP2028 (trademark, manufactured by Idemitsu Chemicals).

<Liquid Developer A8>

Liquid developer A8 was obtained in a similar manner to that for liquid developer A1 except that the insulating liquid used for liquid developer A1 was replaced with 100 parts by mass of Moresco White P-60 (trademark, manufactured by Moresco Corporation).

<Liquid Developer B5>

Liquid developer B5 was obtained in a similar manner to that for liquid developer B1 except that the insulating liquid used for liquid developer B1 was replaced with 100 parts by mass of Isopar G (trademark, manufactured by Exxon Mobil Chemical).

<Liquid Developer B6>

Liquid developer B6 was obtained in a similar manner to that for liquid developer B1 except that the insulating liquid used for liquid developer B1 was replaced with 100 parts by mass of IP1620 (trademark, manufactured by Idemitsu Chemicals).

<Liquid Developer B7>

Liquid developer B7 was obtained in a similar manner to that for liquid developer B1 except that the insulating liquid used for liquid developer B1 was replaced with 100 parts by mass of IP2028 (trademark, manufactured by Idemitsu Chemicals).

<Liquid Developer B8>

Liquid developer B8 was obtained in a similar manner to that for liquid developer B1 except that the insulating liquid used for liquid developer B1 was replaced with 100 parts by mass of Moresco White P-60 (trademark, manufactured by Moresco Corporation).

<Liquid Developer C5>

Liquid developer C5 was obtained in a similar manner to that for liquid developer C1 except that the insulating liquid used for liquid developer C1 was replaced with 100 parts by mass of Isopar G (trademark, manufactured by Exxon Mobil Chemical).

<Liquid Developer C6>

Liquid developer C6 was obtained in a similar manner to that for liquid developer C1 except that the insulating liquid used for liquid developer C1 was replaced with 100 parts by mass of IP1620 (trademark, manufactured by Idemitsu Chemicals).

<Liquid Developer C7>

Liquid developer C7 was obtained in a similar manner to that for liquid developer C1 except that the insulating liquid used for liquid developer C1 was replaced with 100 parts by mass of IP2028 (trademark, manufactured by Idemitsu Chemicals).

<Liquid Developer C8>

Liquid developer C8 was obtained in a similar manner to that for liquid developer C1 except that the insulating liquid used for liquid developer C1 was replaced with 100 parts by mass of Moresco White P-60 (trademark, manufactured by Moresco Corporation).

4. Measurement of Tm (Melting Temperature) of Toner Particles

Tm of toner particles A to C was measured by means of a flow tester (trademark: "CFT-500D") manufactured by Shimadzu Corporation under the following measurement conditions.

<Measurement Conditions>

Temperature at the start of measurement: 50° C.

Temperature at the end of measurement: 200° C.

Weight: 0.5 kg

Temperature increase rate: 5° C./min

Die hole diameter: 0.5 mm

Die hole length: 1 mm

Residual heat time: 60 seconds

Evaluation: With the piston stroke position "S," the temperature at ½ of the difference between the terminal point of piston stroke Smax and the minimum value 5 min was determined as Tm (=T½ temperature).

<Measurement Method>

5 ml of any of the liquid developers including respective types of toner particles is centrifuged at 25° C. and 2000 rpm for 20 minutes and thereafter the supernatant is discarded. Then, to the precipitate, hexane is added and they are stirred and cleaned. After this, the precipitate is dispersed by ultrasonic waves for 30 seconds, and centrifuging is performed at 25° C. and 2000 rpm for 20 minutes.

After this, the supernatant (hexane) is discarded. To the precipitate, hexane is added and they are stirred and cleaned again. The precipitate is dispersed by ultrasonic waves for 30 seconds, and subsequently centrifuging is performed at 25° C. and 2000 rpm for 20 minutes. This step is repeated further twice.

Subsequently, the supernatant is discarded, the precipitate is scraped off onto filter paper, and the scraped sample is dried in a vacuum drier at 25° C. for one hour to thereby obtain about 1 g of dry toner particle sample.

Then, the dry toner particles are measured under the above-indicated measurement conditions to determine Tm. Tm thus measured had a numerical value substantially identical to Tm of toner particles before they were in the form of the liquid developer.

5. Measurement of Carbon Number of Insulating Liquid in Liquid Developer

The aliphatic saturated hydrocarbon included in the insulating liquid in the liquid developer was identified in terms of the carbon number of the aliphatic saturated hydrocarbon, in accordance with the GC-TOFMS method (Gas Chromatography-Time-of-Flight Mass Spectrometry). The measurement was done under the following conditions. The results are shown in Tables 1 to 4. In Tables 1 to 4, the column "C11-16" under the item "Carbon Number of Insulating Liquid" indicates the ratio (mass %) of the aliphatic saturated hydrocarbon having a carbon number of 11 to 16 with respect to the insulating liquid included in the liquid developer indicated in its left column, the column "C11-12" indicates the ratio (mass %) of the aliphatic saturated hydrocarbon having a carbon number of 11 to 12 with respect to the insulating liquid included therein, and the column "C15-16" indicates the ratio (mass %) of the aliphatic saturated hydrocarbon having a carbon number of 15 to 16 with respect to the insulating liquid included therein. In the column "C11-16," the cells in which the ratio is not 100.0 (mass %) means that aliphatic saturated hydrocarbon having a carbon number other than 11 to 16 was included.

<Gas Chromatography>

Apparatus: 6890N (manufactured by Agilent)

Injection conditions: temperature 280° C., Split (1:200)

Column used: DB-5 ms (length 30 mm, inner diameter 0.25 mm, film thickness 0.25 μm)

Oven: the temperature is increased from 50° C. at a rate of 15° C./min to 280° C. and kept for 5 minutes Sample: insulating liquid of the same composition as the insulating liquid included in each liquid developer Amount of injected sample: 0.1 μL Carrier gas: helium (1 ml/min)

Interface temperature: 250° C.

<Time-of-Flight Mass Spectrometry>

Apparatus: time-of-flight mass spectrometer JMS-T100GC (manufactured by JEOL Ltd.)

Ionization: electric field ionization (cathode voltage: −10 kV)

Range of mass: m/z 35 to 500

6. Evaluation of Fixing Strength and Offset

Each liquid developer produced in the above-described mariner was used to produce each fixing sample by the apparatus shown in FIG. 1 (the fixing unit is shown in FIG. 2 or 3) as described above. The fixing process is generally the one described later herein.

The paper used as a recording material was Kinbishi 128 g/m$^2$ paper (trademark) manufactured by Mitsubishi Paper Mills Ltd. The temperature of the fixing unit was adjusted as appropriate in order to obtain a desired paper temperature. Specifically, the Examples and Comparative Examples shown in Tables 1 to 2 were fixed by means of the device shown in FIG. 2 described above as the fixing unit, the temperature of the recording material at point T2 was set to six different temperatures: 120° C., 130° C., 140° C., 150° C., 160° C., and 170° C., and the fixing strength and offset at each set temperature were evaluated in the following way. The Examples and Comparative Examples shown in Table 3 were fixed similarly to those in Tables 1 to 2 by means of the device shown in FIG. 2 described above as the fixing unit, the temperature of the recording material at point T2 was set to six different temperatures: 100° C., 110° C., 120° C., 130° C., 140° C., and 150° C., and the fixing strength and offset at each set temperature were evaluated in the following way. In contrast, the Examples and Comparative Examples shown in Table 4 were fixed by means of the device shown in FIG. 3 described above as the fixing unit, the temperature of the recording material at point T1 was set to six different temperatures: 120° C., 130° C., 140° C., 150° C., 160° C., and 170° C., and the fixing strength and offset at each set temperature were evaluated in the following way. The amount of the toner particles fixed on the paper (recording material) was 4 g/m$^2$ of solid toner particles forming a solid image.

<Evaluation of Fixing Strength>

The fixing strength of each fixing sample was evaluated by a tape peel test. Specifically, a tape was attached to each fixing sample and then peeled off from the sample. The amount of toner particles removed by the peeled-off tape was measured for use as an image density (ID).

More specifically, a tape of 20 mm in width (trademark: "scotch mending tape 810" manufactured by the 3M company) was attached to an image face (about 50 mm in length) of the fixing sample, and the tape surface was pressed sufficiently with a finger. After this, the tape was peeled off and the peeled-off tape was attached to paper "CF-80" (trademark) manufactured by Konica Minolta Business Solutions. Subsequently, on "CF-80" to which the tape was attached, the ID of the portion where toner particles did not stick was calibrated to zero and the ID of the portion where toner particles stuck was measured with an ID meter (trademark "Spectroeye LT" manufactured by X-Rite Inc.). An ID of less than 0.05 was evaluated as "A," an ID of not less than 0.05 and less than 0.1 was evaluated as "B," and an ID of not less than 0.1 was evaluated as "C." A smaller numerical value of the ID represents a superior fixing strength. The results are shown in Tables 1 to 4.

<Evaluation of Offset>

Whether or not offset (stain) occurred to fixing rollers 901, 905 and heating rollers 902, 906 in FIGS. 2 and 3 was observed to thereby evaluate. offset. This evaluation was made by passing each fixing sample through these rollers, thereafter separately passing "CF-80" therethrough, and observing with eyes whether this "CF-80" was stained or not.

A sample having caused no stain was evaluated as "A," a sample having caused a slight stain was evaluated as "B," and a sample having caused an obvious stain was evaluated as "C." Samples having caused less stain mean that offset is prevented to a greater extent. The results are shown in Tables 1 to 4.

<Overview of Fixing Process>

Each liquid developer obtained in the above-described manner (in each Example and each Comparative Example in Tables 1 to 4, the liquid developers indicated in the tables were used (for example, "A1" represents liquid developer A1 described above)) was placed in developer tank 44 of image forming apparatus 10 shown in FIG. 1 to thereby cause the apparatus to operate, an image was formed on recording material 11, and the image was fixed by fixing unit 9 (FIG. 2 or 3). The image was formed specifically under the following conditions.

The system speed was set to 400 mm/sec, and a negatively charged OPC (organic photoconductor) was used as the photoreceptor. The charge potential of the photoreceptor was set to −700 V, the development voltage was set to −450 V, the intermediate transfer roller voltage was set to +300 V, and the secondary transfer roller voltage was set to +1000 V.

In FIGS. 2 and 3, T1 and T2 are each the position located 10 mm away from the exit of the nip portion (namely the position where the recording material passed 0.025 seconds after the time when it passed the exit of the nip portion, since the system speed is 400 mm/sec), and are each the position where the temperature of the recording material was measured with a thermopile (trademark: "FT-H10" manufactured by Keyence Corporation). The conditions for measurement were that the focal length was 35 mm, the emissivity was 0.95, and the response time was 0.03 seconds.

TABLE 1

| | Liquid | Carbon Number of Insulating Liquid | | | Fixing Strength/Offset | | | | | |
|---|---|---|---|---|---|---|---|---|---|---|
| | Developer | C11-16 | C11-12 | C15-16 | 120° C. | 130° C. | 140° C. | 150° C. | 160° C. | 170° C. |
| Comparative Example 1 | A5 | 56.0 | 56.0 | 0.0 | C/A | C/A | C/A | A/C | A/C | A/C |
| Comparative Example 2 | A6 | 92.2 | 92.2 | 0.0 | C/A | C/A | C/A | A/C | A/C | A/C |
| Example 1 | A1 | 100.0 | 58.6 | 7.3 | C/A | C/A | C/A | A/A | A/A | A/C |
| Example 2 | A2 | 100.0 | 49.3 | 41.3 | C/A | C/A | C/A | A/A | A/A | A/A |
| Example 3 | A3 | 98.4 | 31.6 | 64.4 | C/A | C/A | C/A | A/A | A/A | A/A |
| Example 4 | A4 | 95.6 | 20.5 | 72.5 | C/C | C/A | C/A | C/A | A/A | A/A |
| Comparative Example 3 | A7 | 100.0 | 16.5 | 80.5 | C/C | C/C | C/C | C/A | C/A | B/B |
| Comparative Example 4 | A8 | 0.0 | 0.0 | 0.0 | C/C | C/C | C/C | C/C | C/A | C/B |

TABLE 2

| | Liquid | Carbon Number of Insulating Liquid | | | Fixing Strength/Offset | | | | | |
|---|---|---|---|---|---|---|---|---|---|---|
| | Developer | C11-16 | C11-12 | C15-16 | 120° C. | 130° C. | 140° C. | 150° C. | 160° C. | 170° C. |
| Comparative Example 5 | B5 | 56.0 | 56.0 | 0.0 | C/A | A/C | A/C | A/C | A/C | A/C |
| Comparative Example 6 | B6 | 92.2 | 92.2 | 0.0 | C/A | A/C | A/C | A/C | A/C | A/C |
| Example 5 | B1 | 100.0 | 58.6 | 7.3 | C/A | A/A | A/A | A/C | A/C | A/C |
| Example 6 | B2 | 100.0 | 49.3 | 41.3 | C/A | A/A | A/A | A/A | A/C | A/C |
| Example 7 | B3 | 98.4 | 31.6 | 64.4 | C/A | A/A | A/A | A/A | A/C | A/C |
| Example 8 | B4 | 95.6 | 20.5 | 72.5 | C/A | C/A | A/A | A/A | A/C | A/C |
| Comparative Example 7 | B7 | 100.0 | 16.5 | 80.5 | C/C | C/A | C/A | B/B | B/C | A/C |
| Comparative Example 8 | B8 | 0.0 | 0.0 | 0.0 | C/C | C/C | C/A | C/B | C/C | C/C |

TABLE 3

| | Liquid | Carbon Number of Insulating Liquid | | | Fixing Strength/Offset | | | | | |
|---|---|---|---|---|---|---|---|---|---|---|
| | Developer | C11-16 | C11-12 | C15-16 | 100° C. | 110° C. | 120° C. | 130° C. | 140° C. | 150° C. |
| Comparative Example 9 | C5 | 56.0 | 56.0 | 0.0 | A/C | A/C | A/C | A/C | A/C | A/C |
| Comparative Example 10 | C6 | 92.2 | 92.2 | 0.0 | A/C | A/C | A/C | A/C | A/C | A/C |
| Example 9 | C1 | 100.0 | 58.6 | 7.3 | A/A | A/A | A/C | A/C | A/C | A/C |
| Example 10 | C2 | 100.0 | 49.3 | 41.3 | A/A | A/A | A/A | A/C | A/C | A/C |
| Example 11 | C3 | 98.4 | 31.6 | 64.4 | A/A | A/A | A/A | A/C | A/C | A/C |
| Example 12 | C4 | 95.6 | 20.5 | 72.5 | C/A | A/A | A/A | A/C | A/C | A/C |
| Comparative Example 11 | C7 | 100.0 | 16.5 | 80.5 | C/A | C/A | B/B | B/C | A/C | A/C |
| Comparative Example 12 | C8 | 0.0 | 0.0 | 0.0 | C/C | C/A | C/B | C/C | C/C | A/C |

TABLE 4

| | Liquid | Carbon Number of Insulating Liquid | | | Fixing Strength/Offset | | | | | |
|---|---|---|---|---|---|---|---|---|---|---|
| | Developer | C11-16 | C11-12 | C15-16 | 120° C. | 130° C. | 140° C. | 150° C. | 160° C. | 170° C. |
| Comparative Example 13 | C5 | 56.0 | 56.0 | 0.0 | B/C | A/C | A/C | A/C | A/C | A/C |
| Comparative Example 14 | C6 | 92.2 | 92.2 | 0.0 | B/C | A/C | A/C | A/C | A/C | A/C |
| Example 13 | C1 | 100.0 | 58.6 | 7.3 | B/A | A/A | A/C | A/C | A/C | A/C |
| Example 14 | C2 | 100.0 | 49.3 | 41.3 | B/A | A/A | A/A | A/C | A/C | A/C |
| Example 15 | C3 | 98.4 | 31.6 | 64.4 | B/A | A/A | A/A | A/C | A/C | A/C |
| Example 16 | C4 | 95.6 | 20.5 | 72.5 | C/A | B/A | A/A | A/C | A/C | A/C |
| Comparative Example 15 | C7 | 100.0 | 16.5 | 80.5 | C/A | C/A | B/B | B/C | A/C | A/C |
| Comparative Example 16 | C8 | 0.0 | 0.0 | 0.0 | C/C | C/A | C/B | C/C | C/C | A/C |

In Tables 1 to 4, under the item "Fixing Strength/Offset," the results of evaluation of the fixing strength and the results of evaluation of offset are shown in this order for each set temperature. For example, the evaluation "C/A" means that the evaluation of the fixing strength is "C" and the evaluation of offset is "A."

As clearly seen from Tables 1 to 4, the liquid developers of the Examples (namely a liquid developer in which 90 mass % or more of the insulating liquid is aliphatic saturated hydrocarbon having a carbon number of 11 to 16, and 20 to 60 mass % of the insulating liquid is aliphatic saturated hydrocarbon having a carbon number of 11 to 12) achieves both prevention of offset and improvement of the fixing strength (namely evaluation is "A/A") at multiple set temperatures of the fixing unit, as compared with the liquid developers of the Comparative Examples. It has thus been confirmed that the liquid developer of the present invention produces a beneficial effect that prevention of offset and improvement of the fixing strength can both be achieved.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A liquid developer comprising at least toner particles and an insulating liquid, said toner particles including a resin and a color material dispersed in the resin, and 90 mass % or more of said insulating liquid being aliphatic saturated hydrocarbon having a carbon number of 11 to 16, and 20 to 60 mass % of said insulating liquid being aliphatic saturated hydrocarbon having a carbon number of 11 to 12.

2. The liquid developer according to claim 1, wherein 40 to 70 mass % of said insulating liquid is aliphatic saturated hydrocarbon having a carbon number of 15 to 16.

3. The liquid developer of claim 1, wherein the resin has an acid value of 20 mgKOH/g to 100 mgKOH/g.

4. The liquid developer of claim 1, wherein the color material is a pigment having a particle size of 50 to 300 nm.

5. The liquid developer of claim 1, wherein the toner particles have a size of 0.1 to 5 μm.

6. The liquid developer of claim 1 further comprising a dispersant.

7. The liquid developer of claim 6, wherein the dispersant comprises a random copolymer or a graft copolymer of N-vinyl-2-pyrrolidone and methacrylate.

8. The liquid developer of claim 1, wherein the toner particles are prepared by the steps of blending the resin and the color material in a predetermined ratio, melting and kneading to obtain a pigment-dispersed resin, followed by pulverization and classification.

* * * * *